US006032637A

United States Patent [19]

Mamiya et al.

[11] Patent Number: 6,032,637

[45] Date of Patent: Mar. 7, 2000

[54] CONTROL SYSTEM FOR CONTROLLING A FUEL DIRECT INJECTION TYPE OF ENGINE

[75] Inventors: Kiyotaka Mamiya; Michihiro Imada; Masayuki Tetsuno, all of Hiroshima, Japan

[73] Assignee: Mazda Motor Corporation, Hiroshima, Japan

[21] Appl. No.: 09/022,626

[22] Filed: Feb. 12, 1998

[30] Foreign Application Priority Data

Feb. 13, 1997 [JP] Japan ..... 9-029130

[51] Int. Cl.[7] ..... F02D 43/04

[52] U.S. Cl. ..... 123/295; 123/299; 701/104

[58] Field of Search ..... 123/295, 299, 123/305; 701/104, 105

[56] References Cited

U.S. PATENT DOCUMENTS 4,619,234 10/1986 Okamoto ..... 123/357
5,101,785 4/1992 Ito ..... 123/357
5,170,759 12/1992 Ito ..... 123/276
5,313,920 5/1994 Matsushita ..... 123/295

FOREIGN PATENT DOCUMENTS 8189405 7/1996 Japan .

*Primary Examiner*—Tony M. Argenbright
*Assistant Examiner*—Arnold Castro
*Attorney, Agent, or Firm*—Sixbey, Friedman, Leedom & Ferguson, PC; Donald R. Studebaker

[57] ABSTRACT

An engine control system for controlling operation of an engine of a type injecting fuel directly into a combustion chamber in different injection modes according to engine operating conditions has a map of engine control values with respect to specified engine operating conditions at intersection points of a grid pattern in which engine control values at extreme intersection points adjacent to a boundary between adjacent injection modes is discontinual. The engine control system calculates an engine control value for an engine operating condition by interpolation with the aid of engine control values at the intersection points and determines an engine control value for an engine operating condition at a point closer to the boundary than the extreme intersection point of one injection mode based on engine control values at intersection points of the one injection mode only.

10 Claims, 8 Drawing Sheets

CONTROL SYSTEM FOR CONTROLLING A FUEL DIRECT INJECTION TYPE OF ENGINE

BACKGROUND OF THE INVENTION

1. Field of the Invention

The invention relates to a control system for a fuel direct injection type of automobile engine.

2. Description of the Related Art

Fuel direct injection engines are changeable in fuel injection mode according to engine operating conditions. Such a fuel direct injection engine described in, for example, Japanese Unexamined Patent Publication No. 8-189405 is changeable among different injection modes, namely a compression stroke injection mode or latter injection mode taking place during engine operation in a range of lower engine loads where the engine has a demand for a relatively small amount of fuel, an intake stroke injection mode or early injection mode taking place during operation in a range of higher engine loads where the engine has a demand for a relatively large amount of fuel, and a split injection mode taking place during operation in a range of moderate engine loads which is a transitional range from the lower load range to the higher load range and vice versa. The term "compression stroke injection" or "latter injection" mode refers to a mode in which fuel injection is effected at a time in the latter half of an compression stroke of the engine, the term "intake stroke injection" or "early injection" mode refers to a mode in which fuel injection is effected at a time in a period including a full intake stroke and the early half of a compression stroke of the engine, and the term "split injection" mode refers to a mode in which fuel injection is separately effected in an intake stroke and in a compression stroke. This fuel direct injection engine is controlled in operation with a control value such as an ignition time which is determined from a control map according to engine operating conditions and varied according to the injection modes.

Typically, such an ignition control map comprises a great number of intersection points of a grid pattern representing the relationship between parameters concerning engine operating condition and control value. If the parameter is in a position between intersection points, the control value is calculated by interpolation with the aid of values at adjacent intersection points between which the parameter is. For example, as seen in FIG. 9 showing a prior art control map regarding the relationship between engine load and ignition time which defines a latter injection mode area and a split injection mode area, if the present engine load ac is in close proximity to the boundary between the two injection mode areas and takes an in-between position limited by an extreme intersection point Ta in the latter injection mode area and an extreme intersection point Tb in the split injection mode area, an ignition time T for the engine load ac is calculated by interpolation with the aid of values at the intersection points Ta and Tb. That is, the ignition time T takes an intermediate value between the values at the intersection points Ta and Tb. The ignition time varies linearly or continually between the values at the intersections Ta and Tb with a change in engine load.

A transition, for example, from the latter injection mode area to the split injection mode area is generally accompanied by a significant change in engine operating condition which must be too sudden to timely achieve the calculation of ignition time by interpolation, leading to a delay in timely ignition, and hence to unstable engine operation. At a transition from the latter injection mode to the split injection mode, it is necessary to advance ignition timing to cause early combustion depending on expansion of an area for diffusion of injected fuel partly allocated to homogeneous charge combustion. In other words, a minimum advance for best torque (MBT) is needed to be shifted to an advanced side. If the shift of ignition timing toward the advanced side is slow, ignition is hard to occur in well response to a rapid switch of injection mode, which always causes torque shocks.

SUMMARY OF THE INVENTION

It is an objective of the invention to provide an engine control system which controls precisely engine operation quickly following a change in injection mode.

The foregoing object of the present invention is achieved by providing an engine control system for controlling operation of an internal combustion engine of a direct injection type which injects fuel directly into a combustion chamber of the engine in different injection modes, such as an early injection mode in which fuel injection is made in an intake stroke, a split injection mode in which fuel injection is separately made in an intake stroke and in a compression mode and a latter injection mode in which fuel injection is made in a compression stroke, according to engine operating conditions. The engine control system includes a memory which stores data of a control map of engine control values with respect to specified engine operating conditions at intersection points of a grid pattern. In the control map, engine control values for the specified engine operating conditions at extreme intersection points on opposite sides of a boundary between each adjacent injection modes are discontinual. An engine control value for a detected engine operating condition is calculated by interpolation with the aid of engine control values at the intersection points and an engine control value for a detected engine operating condition at a point closer to the boundary of one of the adjacent injection modes than the extreme intersection point of the one injection mode is, and, however, calculated not by interpolation with the aid of an engine control value at the extreme intersection point of the one adjacent injection mode and a value at the extreme intersection point of another of the adjacent injection modes but based only on engine control values at intersection points in the one injection mode.

With the engine control system of the invention, in the event where an engine operating condition is at a point in close proximity to a boundary between adjacent injection modes, an engine control value is not calculated by interpolation with the aid of engine control values at intersection points belonging to the respective adjacent injection modes which are different from each other. As a result, a change in engine control value is prevented from blunting and quickly responds to a switch from one injection mode to another.

The control map may further define a virtual intersection point as one of intersection point for the one injection mode which is assigned to an engine operating condition demanding engine operation in the other injection mode and specifies an engine control value which is suitably taken assuming that the engine operates with the engine operating condition in the one injection mode. When an engine operating condition is at a point in close proximity to the boundary between the adjacent injection modes, the engine control value is calculated by interpolation with the aid of the engine control values at the extreme intersection point and the virtual intersection point both of the one injection mode to which the engine operating condition belongs. Or otherwise, the engine control value for an engine operating condition at a point in close proximity to the boundary between the adjacent injection modes may be determined based only on engine control values of the one injection mode to which the engine operating condition belongs. For example, the engine control value at the extreme intersection point of the one injection mode is taken as the engine control value for an engine operating condition at a point closer to the boundary between the adjacent injection modes than the extreme intersection point of the one injection mode.

The control map may comprises a single map section covering the entire range of engine operating conditions, or otherwise may comprise map sections specified to at least two injection modes, respectively. Specifically, the control map comprises map sections specified to at least two of an early injection mode in which fuel injection is made in an intake stroke, a latter injection mode in which fuel injection is made in a compression stroke, and a split injection mode in which fuel injection is separately made in an intake stroke and in a compression stroke. This control map permits a simple calculation of engine control value based on engine control values at the intersection points of a control map for one injection mode to which the engine operating condition belongs, which always desirable for changing an engine control value in response to a switch of injection mode.

In the latter injection mode a fuel injection time is determined so as to force fuel to reach near around an ignition plug at or until a time of ignition, as a result of which, fuel is concentrated locally around the ignition plug so as to be enriched relatively to other part in the combustion chamber and stratified charge combustion is stably made with an effect of reduced fuel consumption.

It is desirable to switch the early injection mode, the split injection mode and the latter injection in this order in a direction in which an engine load as the engine operating condition increases.

In the case where an ignition time is controlled as the engine control value, it is desired to establish the control map so that an ignition time is discontinually advanced in order for the engine to provide sufficient output torque during a switch from the latter injection mode to the split injection mode or during a switch from the split injection mode to the early injection mode. This is because, during such a switch of injection mode, the proportion of fuel which is diffused uniformly in the combustion chamber is increased.

BRIEF DESCRIPTION OF THE DRAWINGS

The foregoing and other objects and features of the present invention will be clearly understood from the following detailed description of preferred embodiments when read in conjunction with the accompanying drawings in which.

DETAILED DESCRIPTION OF THE PREFERRED EMBODIMENT

Figure 1:
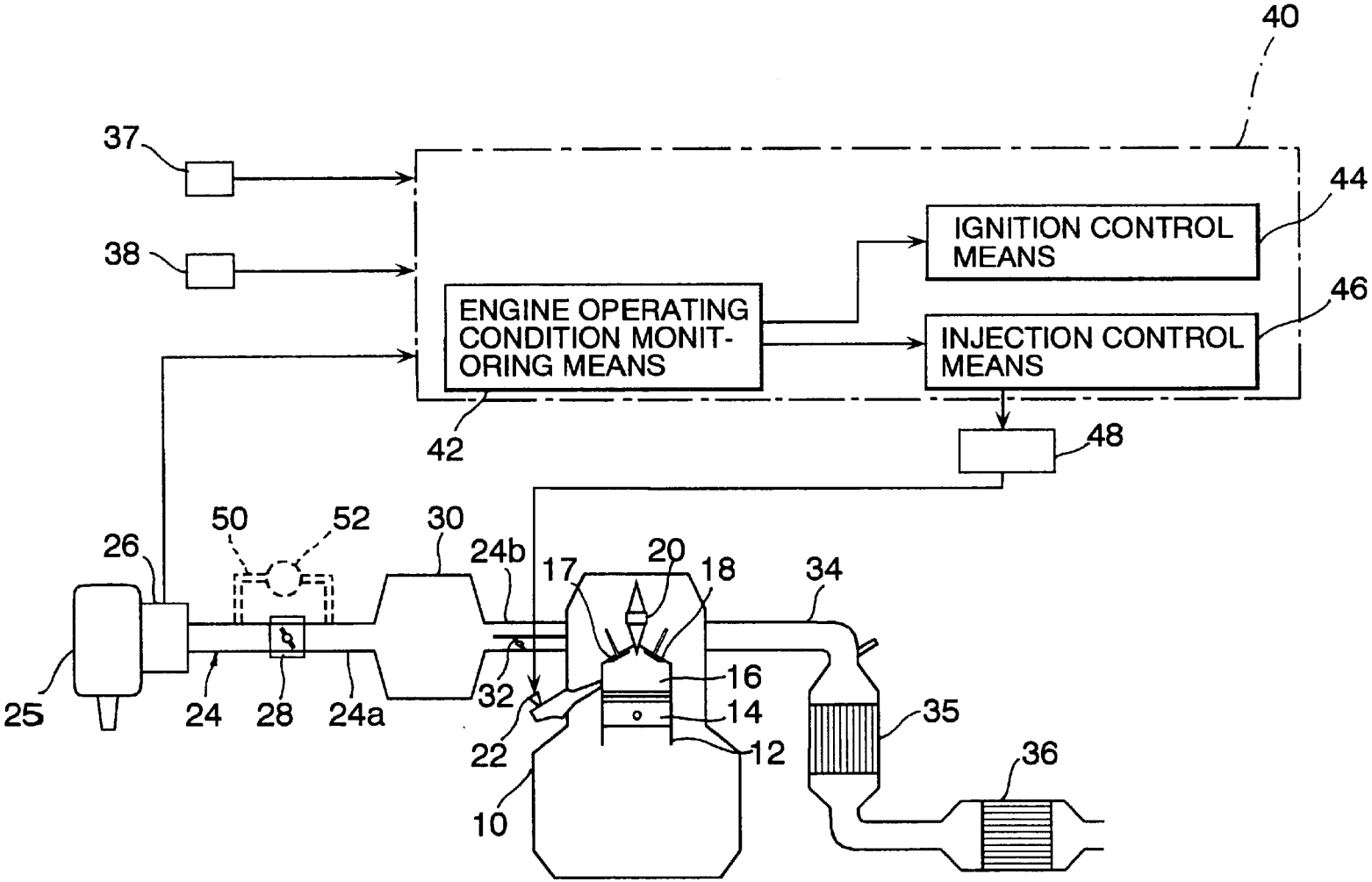
FIG. 1 is a schematic illustration of a fuel direct injection type of internal combustion engine equipped with an engine control system in accordance with an embodiment of the invention.

Referring to the drawings in detail and, in particular, to FIG. 1 showing a fuel direct injection type of internal combustion engine 10 with an engine control system in accordance with an embodiment of the invention, the engine 10 has a plurality of cylinders 12 (only one of which is shown) in which a piston 14 is received and slides. A combustion chamber 16 is formed above a top of the piston 14 in the cylinder 12. The cylinder 12 is provided with two intake ports and two exhaust ports, all of which open into the combustion chamber 16 and are opened and shut at predetermined timings by intake valves 17 and exhaust valves 18, respectively. The engine 10 is equipped with an ignition or spark plug 20 with the electrode tip placed down into the combustion chamber 16. A direct injection valve 22 is installed to a side wall of the engine to inject fuel directly into the combustion chamber 16. Various types of fuel injectors are known in the art, and the fuel injector 22 may take any well known type. The fuel injector 22, which incorporates a needle valve and solenoid (both of which are not shown), keeps the needle valve open depending upon a pulse width of a fuel injection pulse adjusted and supplied to the solenoid so as to deliver a correct air-fuel ratio for any given engine demand.

Intake air is introduced into the cylinder 12 through an intake passage 24 comprising a common intake pipe 24*a* as an upstream part and two separate intake pipes 24*b* as a downstream part branching off from the downstream end of the common intake pipe 24*a* to the intake ports, respectively. The common intake pipe 24*a* is equipped in order from the upstream end with an air cleaner 25, an air flow sensor 26, an electrically controlled engine throttle 28 and a surge tank 30. One of the separate intake pipe 24*b* is equipped with a swirl control valve 32 by which the intake port is opened and shut. Exhaust gas is discharged through an exhaust passage 34 equipped with emission control devices such as catalytic converters 35 and 36 for converting emissions.

The engine 10 is further equipped with various sensors including an engine speed sensor 37 and a throttle position sensor 38 for generating and sending engine speed signal and throttle position signal to an engine control unit 40 as schematically shown in block in FIG. 1. The engine control unit 40 comprises a microcomputer having functional blocks, namely operating condition monitoring means 42, fuel injection control means 44, and ignition control means 46.

The operating condition monitoring means 42 receives signals from at least the sensors 26, 37 and 38 to constantly monitor engine operating conditions including engine speed, load, throttle position, etc.

Figure 2:
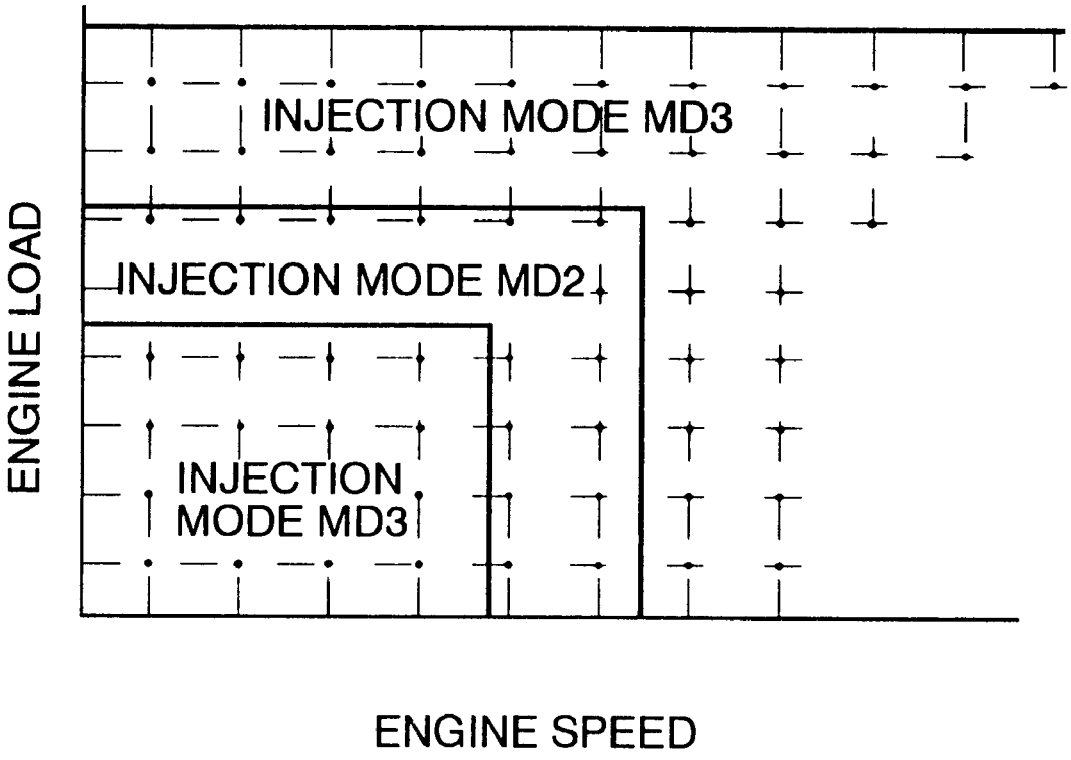
FIG. 2 is a diagrammatic illustration showing fuel injection modes.

The fuel injection control means 44 determines the amount of fuel to be injected and a time of fuel injection according to engine operating conditions and provides control signals for an injector driver 48. The injector driver 48 pulses and causes each fuel injector to open. The width of pulse is constantly adjusted based on the incoming signals so as to deliver correct air-fuel ratio for any given engine demand. The fuel injection control means 44 memorizes data relating to injection time and ignition time in the form of a control map defined by injection control modes specified according to engine speed and load (which is represented by throttle position or opening in this embodiment) as parameters. Injection control is performed in different injection modes MD1, MD2 and MD3 which are selected according to engine operating conditions, i.e. engine speed and engine load, specified at intersection points of a grid pattern shown in FIG. 2. Grid pattern in FIG. 2 is shown only for the purpose of explanation.

Figure 3:
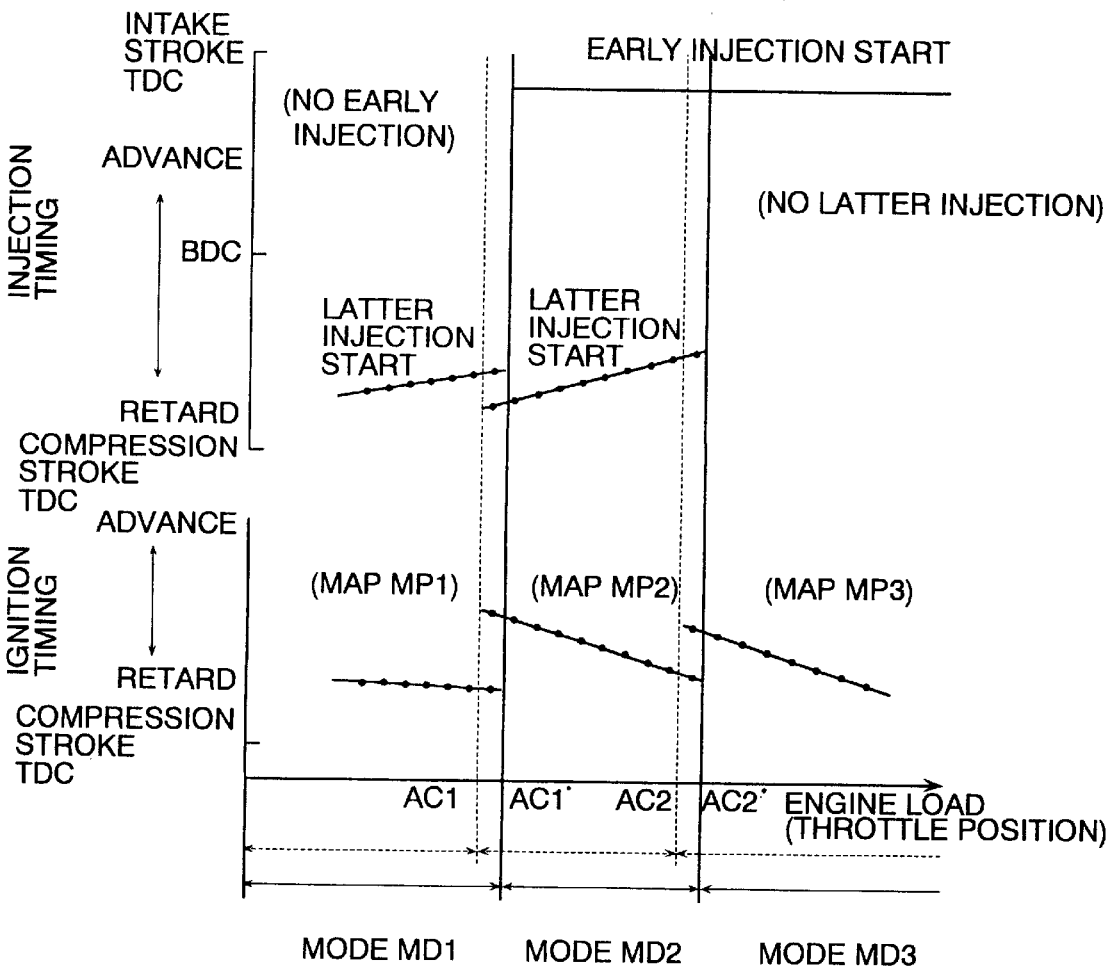
FIG. 3 is a diagrammatic illustration showing a control map of injection time and ignition time with respect to engine operating condition.

FIG. 3 shows a control map of injection time and ignition time for a relatively low engine speed such as 1,500 rpm by way of example. This control map is divided into two map sections for injection time and ignition time. The injection control map section defines three injection modes according to engine loads, namely first, second and third injection modes MD1, MD2 and MD3 in order from the lower load side. Each injection control map takes the form of grid pattern, at intersection points of which injection times are plotted. There is provided a hysteresis between an increasing engine load and a decreasing engine load at a boundary of adjacent injection modes. Specifically, an engine load at a boundary between the first and second injection modes MD1 and MD2 takes a value AC1 when decreasing and a value AC1' greater than the value AC1 when increasing. Similarly, an engine load at a boundary between the second and third injection modes MD2 and MD3 takes a value AC2 when decreasing and a value AC2' greater than the value AC2 when increasing.

The first injection mode MD1 is provided for a low engine load range in which the engine 10 has a demand for a small amount of fuel and latter injection (which refers to fuel injection made in a compression stroke) is made to stratify a fuel mixture in a manner that fuel is charged so as to be lean in the whole area of combustion chamber 16 and, however, concentrated locally around the ignition plug 20 so as to be enriched relatively to other part in the combustion chamber 16. Accordingly, in the first injection mode MD1, an fuel injection time relative to an ignition time is determined so as to force fuel to reach directly around the ignition plug 20, or otherwise to rebound from the top of the piston 14 with an effect of being directed toward the ignition plug 20. The second injection mode MD2 is provided for a moderate engine load range, i.e. a transitional range between the lower engine load range and a higher engine load range, in which split injection (which refers to fuel injection made partly in an intake stroke and partly in a compression stroke) is made to cause homogeneous charge combustion of part of the necessary amount of fuel mixture through early injection (which refers to fuel injection made in an intake stroke) and stratified charge combustion of the remaining part of the necessary amount of fuel mixture through latter injection. The third injection mode MD3 is provided for a higher engine load range in which the engine 10 has a demand for a large amount of fuel and early fuel injection is made to charge fuel uniformly in the whole area of combustion chamber 16.

The ignition control means 46 determines and controls an ignition time relative to an injection time according to engine operating conditions. The ignition control map section comprises three ignition time control maps, namely first, second and third ignition time control maps MP1, MP2 and MP3 in order from the lower load side, provided correspondingly to the first, second and third injection control mode MD1, MD2 and MD3, respectively. Each injection control map takes the form of grid pattern, at intersection points of which ignition times are plotted. An ignition time at a practical engine load is calculated by interpolation with the aid of values at intersection points between which the practical engine load is.

The first ignition control map MP1 is provided correspondingly to the first injection mode MD1 for the lower engine load range in which, while a small amount of fuel is charged, a large amount of air is introduced to cause stratified charge combustion. Because there is almost no change in combustion speed in the lower engine load range, ignition is made at substantially a fixed timing in spite of engine load. During a switch from the first injection mode MD1 to the second injection mode MD2, fuel is partly used for homogeneous charge combustion and diffused in an increased area of combustion chamber 16, which causes a demand for advanced ignition and early commencement of fuel injection in order for the engine 10 to produce sufficient engine output torque. For this reason, the first and second ignition control maps MP1 and MP2 are designed and adapted to advance ignition time discontinually during a switch from the first injection mode MD1 to the second injection mode MD2. Similarly, fuel is entirely used for homogeneous charge combustion, the second and third ignition control maps MP2 and MP3 are designed and adapted to advance an ignition time discontinually during a switch from the second injection mode MD2 to the third injection mode MD3 for the same reason. Further, each of the second and third ignition control maps MP2 and MP3 for the moderate and higher engine load ranges, respectively, in which the amount of fuel to be injected is increased with an increased in engine load is designed and adapted to retard ignition timing with an increase in engine load. Although a change in engine speed is accompanied by fluctuations in ignition timing relative to throttle positions, the control map provided for an engine speed of 1,500 rpm shown in FIG. 3 by way of example is basically available for various engine speeds. In the event where a throttle position has a value at a position within an ignition control map and in close proximity to a boundary of the ignition control map, in other words, at a position between an extreme intersection point of the ignition control map and an extreme intersection point of an adjacent ignition control map, the ignition control means 46 calculates an ignition time based only on the value defined not in the adjacent ignition control map but in the ignition control map which the throttle position belongs to.

Each adjacent ignition control maps overlap with each other in conformity with the hysteresis for throttle position. Specifically, a boundary throttle position between the first and second ignition control maps MP1 and MP2 is given a value AC1' in a direction in which engine load (throttle position) increases and a value AC1, smaller than the value AC1', in a direction in which engine load (throttle position) decreases. Similarly, a boundary throttle position between the second and third ignition control maps MP2 and MP3 is given a value AC2' in the increasing direction and a value AC2, smaller than the value AC2', in the decreasing direction. Whereas, it is not necessary to provide hysteresis in these control maps, however, the provision of hysteresis yields an effect of eliminating or significantly reducing hunting.

Figure 4:
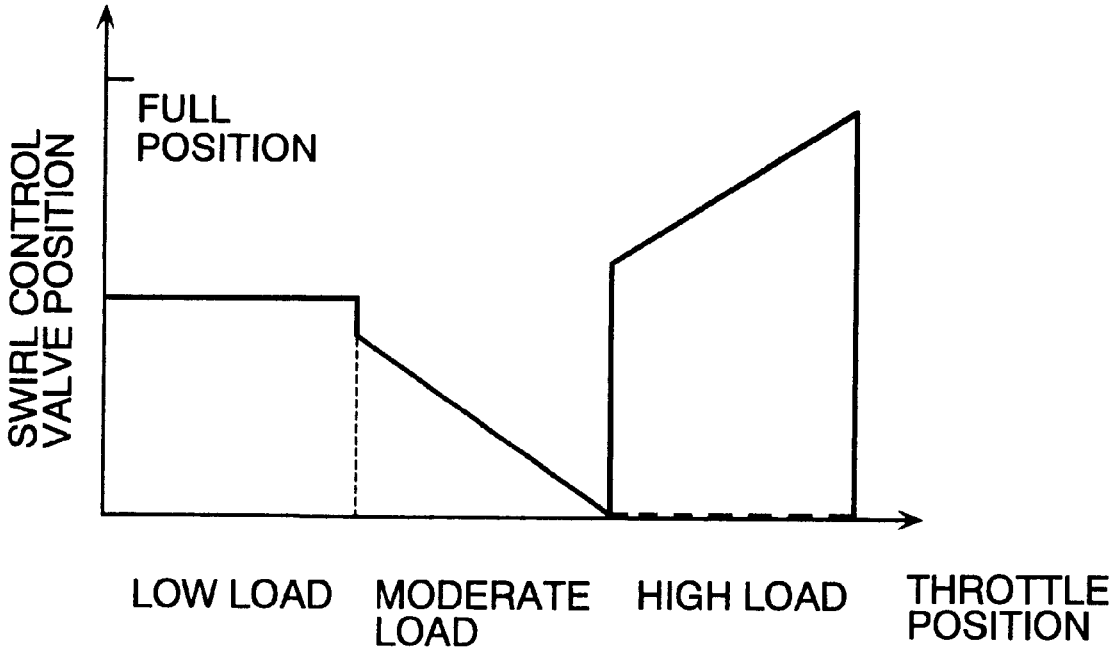
FIG. 4 is a diagrammatic illustration showing the relationship between opening of a swirl control valve and engine load.

The engine control unit 40 controls the swirl control valve 32 to open variably according to engine operating conditions. Specifically, the engine control unit 40 causes the swirl control valve 32 to remain open constantly in spite of engine load in a range of higher engine speeds and to vary its opening according to engine loads as shown in FIG. 4 in a range of lower engine speeds. As shown in FIG. 4, because if a strong swirl of air is generated in the first injection mode MD1 for the lower engine load range in which a small amount of fuel is injected, fuel is diffused too far to achieve favorable stratified charge combustion, the swirl control valve 32 is controlled to remain open half. However, the swirl control valve 32 is controlled to close gradually with an increase in engine load in the moderate engine load range and to remain fully closed in the higher engine load range.

Figure 5:
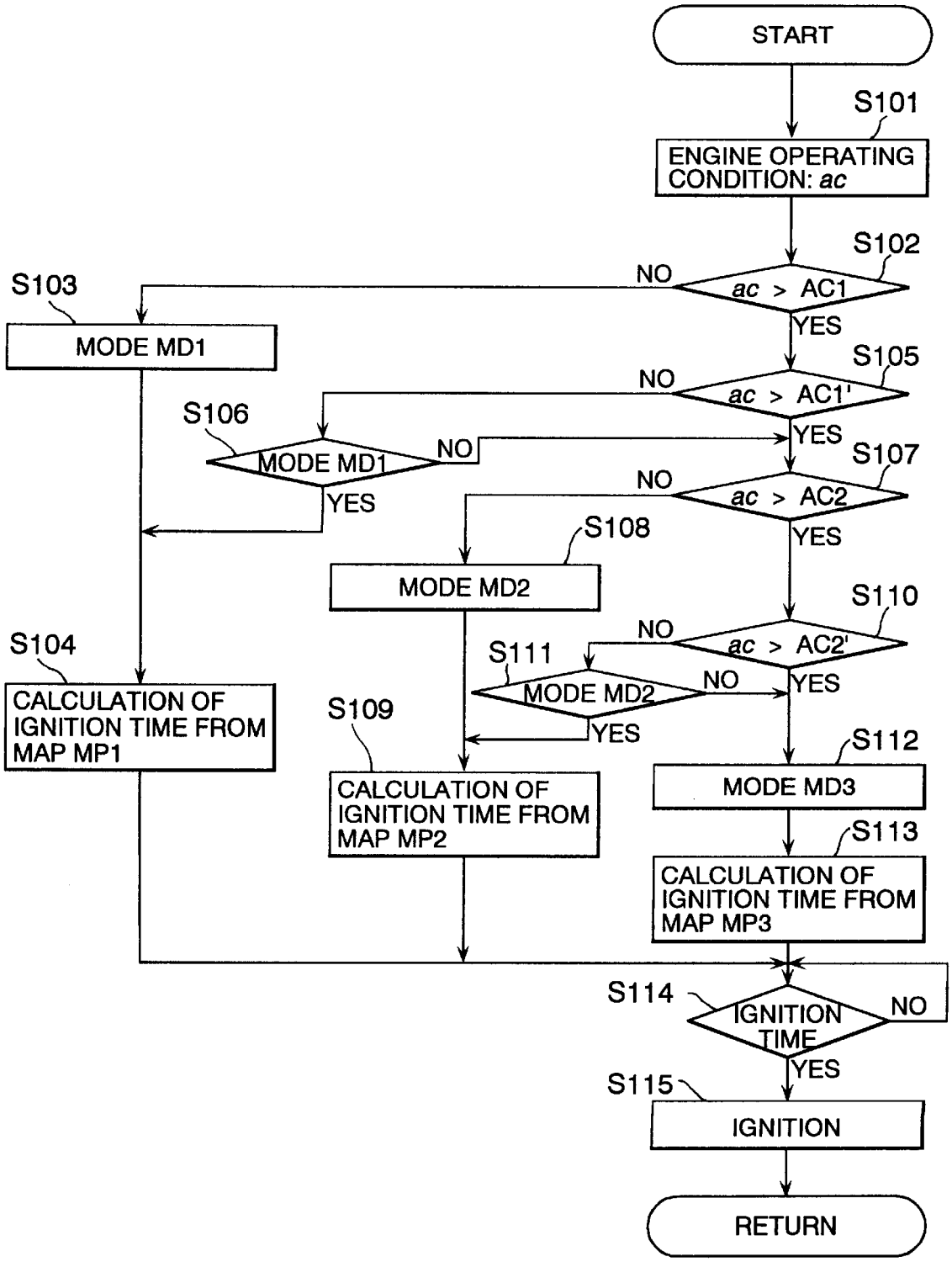
FIG. 5 is a flow chart illustrating an ignition timing control sequence routine for a microcomputer of an engine control unit.
Figure 6:
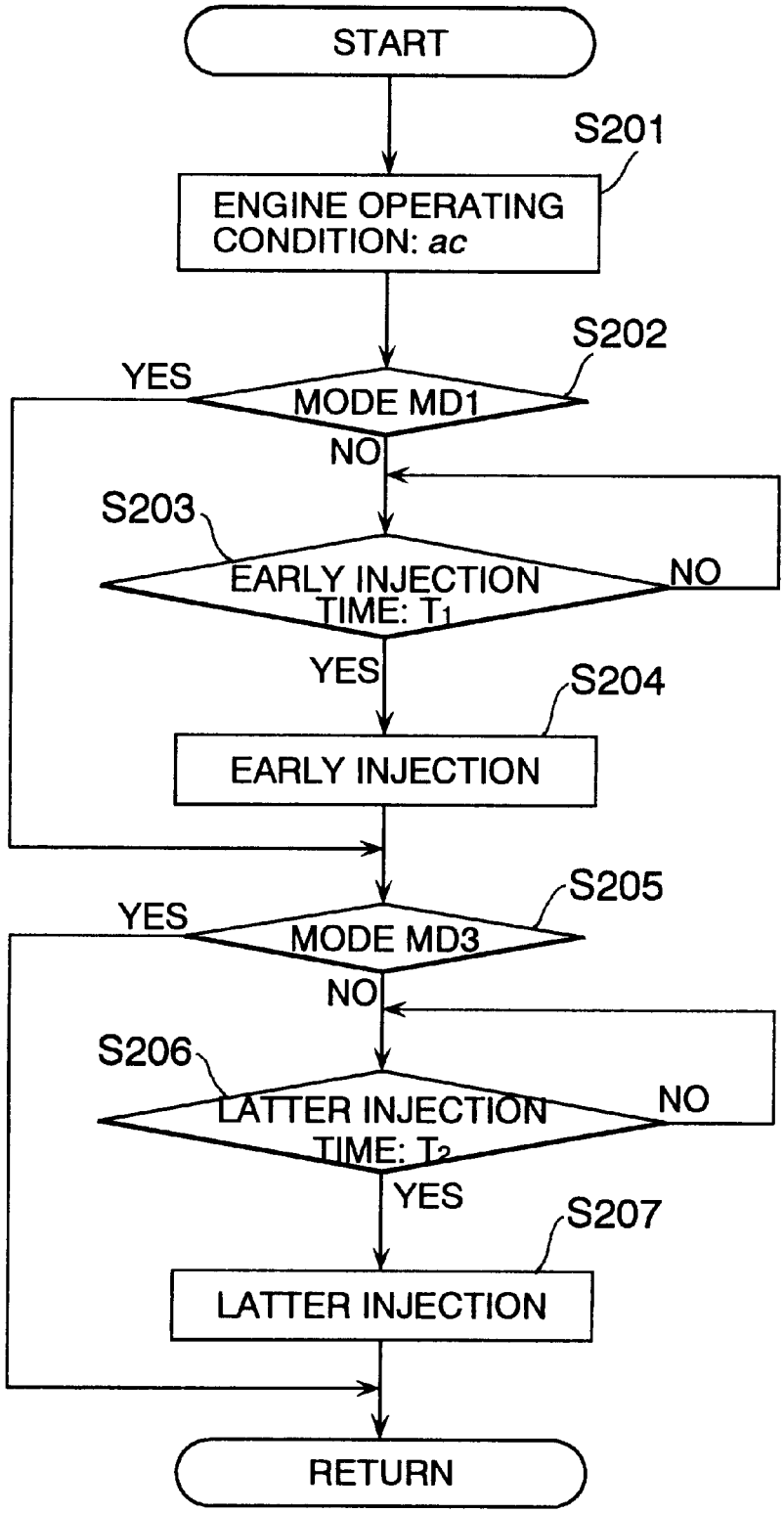
FIG. 6 is a flow chart illustrating an injection control sequence routine for the microcomputer of the engine control unit.

The operation of the engine control system depicted in FIG. 1 is best understood by reviewing FIGS. 5 and 6, which are flow charts illustrating routines for the microcomputer of the engine control unit 40.

Referring to FIG. 5 showing a flow chart illustrating the ignition time control sequence routine, the flow chart logic commences and control proceeds directly to a function block at step S101 where an engine operating condition including a current throttle position or opening ac is detected. Subsequently, the throttle position ac is compared with the boundary value AC1 which belongs to the second injection control mode MD2 at step S102. When the throttle position ac is equal to or smaller than the boundary value AC1, this indicates that the throttle position ac has a value for which the first injection control mode MD1 is taken, then, after switching injection control to the first injection control mode MD1 at step S103, an injection time is calculated by interpolation with the aid of values lying on intersection points within the first ignition control map MP1 corresponding to the first injection control mode MD1 at step S104. On the other hand, when the throttle position ac is greater than the boundary value AC1, it is further compared with the boundary value AC1' which belongs to the first injection control mode MD1 at step S105. When the throttle position ac is equal to or smaller than the boundary value AC1', a determination is made at step S106 as to whether injection control is in the first injection control mode MD1. When the first injection control mode MD1 is taken, an injection time is calculated by interpolation with the aid of values lying on intersection points within the first ignition control map MP1 corresponding to the first injection control mode MD1 at step S104. When the throttle position ac is greater than the boundary value AC1' or when the first injection control mode MD1 is not taken even while the throttle position ac is equal to or smaller than the boundary value AC1', then, the throttle position ac is compared with the boundary value AC2 which belongs to the third injection control mode MD3 at step S107. When the throttle position ac is equal to or smaller than the boundary value AC2, this indicates that the throttle position ac has a value for which the second injection control mode MD2 is taken, then, after switching injection control to the second injection control mode MD2 at step S108, an injection time is calculated by interpolation with the aid of values lying on intersection points within the second ignition control map MP2 corresponding to the second injection control mode MD2 at step S109. On the other hand, when the throttle position ac is greater than the boundary value AC2, it is further compared with the boundary value AC2' which belongs to the second injection control mode MD2 at step S110. When the throttle position ac is equal to or smaller than the boundary value AC2', a determination is made at step S111 as to whether injection control is in the second injection control mode MD2. When the throttle position ac is greater than the boundary value AC2' or when the second injection control mode MD2 is not taken while the throttle position ac is equal to or smaller than the boundary value AC2', after changing fuel injection to the third injection control mode MD3 at step S112, an injection time is calculated by interpolation with the aid of values lying on intersection points within the third ignition control map MP3 corresponding to the third injection control mode MD3 at step S113. Although the calculation of ignition time is basically achieved by interpolation at step S104, S109 or S113, an ignition time may be calculated by interpolation in the event where there is only one intersection point closely around a point at which a throttle position ac lies or where a throttle position ac exactly lies on an intersection point.

After the calculation of ignition time at step S104, S109 or S113, a determination is subsequently made at step S114 as to whether it is time for fuel injection. The determination is repeatedly made until the ignition time has come. Finally, the ignition plug 20 is timely actuated to spark to fire a fuel mixture in the combustion chamber 16 at step S115.

Referring to FIG. 6 showing a flow chart illustrating the injection timing control sequence routine, the flow chart logic commences and control proceeds directly to a function block at step S201 where an engine operating condition including a current throttle position or opening ac is detected and the amount of fuel to be injected is read from a map according to the engine operating condition. Subsequently, fuel injection is made in any given injection control mode determined at step S103, S108 or S112 in the ignition timing control sequence routine. Specifically, a determination is made at step S202 as to whether fuel injection should be made in the first injection control mode MD1. When the answer to the determination is "NO," this indicates that either one of the second and third injection control modes MD1 and MD2 in which both early injection and latter injection take place has been selected, then, after waiting until the injection time T1 for the early injection at step S203, the early injection is timely made at step S204. Thereafter, a determination is made at step S205 as to whether the injection control mode is the third mode MD3. When the answer to the determination is "NO," this indicates that the injection control mode is not the third mode MD3 but the second mode MD2, then, after waiting until the injection time T2 for the latter injection at step S206, the latter injection is timely made at step S207. On the other hand, when the answer to the determination made at step S205 is "YES," this indicates that the injection control mode is not the second mode MD2 but the third mode MD3, then, the flow chart logic orders return without further executing the latter injection.

Whenever the answer to the determination made at step S102 is "YES," i.e. the injection control mode is the first mode MD1, the answer to the determination made at step S205 is "NO," then, after waiting until the injection time T2 for the latter injection at step S206, the latter injection is timely made at step S207.

As described above, the engine control system of the invention selectively determines the first to third injection modes MD1–MD3 according to engine operating conditions and calculates an ignition time with the aid of an ignition control map provided correspondingly to the selected fuel injection control mode. In the event where an engine operating condition is close to the boundary value, values at intersection points within an ignition control map for an injection mode to which the engine operating condition belongs are used to determine the ignition time suitably for the engine operating condition on condition that a calculation of ignition time by interpolation with the aid of values at intersection points lying within ignition control maps corresponding to both adjacent injection modes is prohibited.

Figure 7:
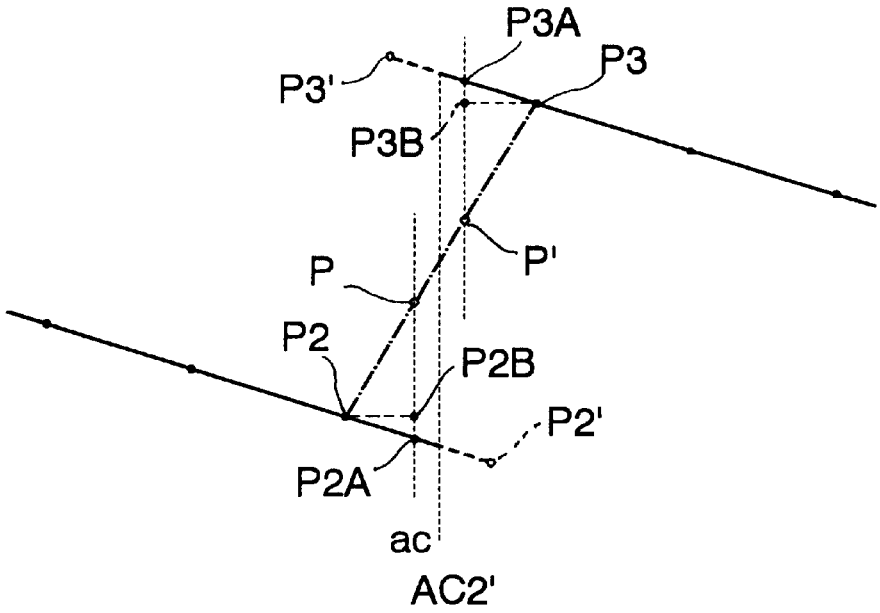
FIG. 7 is an explanatory illustration showing a calculation of ignition time.

In the event where an engine operating condition is close to the boundary value of an injection mode, an ignition time is calculated by interpolation with the aid of a value within an ignition control map provided correspondingly to the injection mode to which the engine operating condition and a value within an ignition control map provided correspondingly to another injection mode adjacent to that injection control mode. Specifically, as shown in FIG. 7 by way of example, when an operating condition, i.e. a throttle position or opening ac, of an increasing engine load, lies in close proximity to the boundary between the second and third ignition maps MP2 and MP3 or is slightly lower than a value at the boundary between the second and third ignition maps MP2 and MP3, an ignition time T at a point P2A for the throttle position or opening ac is calculated by interpolation with the aid of a value at an extreme intersection point P2 of the second ignition control map MP2 which is the closest intersection point to the boundary whose value is AC2' and a value at a virtual point P2' established on a higher throttle side from the boundary value AC'. The calculation by interpolation is made as follows:

$$T(P2A)=T(P2)+\{[ac-ac(P2)]/[ac(P2')-ac(P2)]\}\times[T(P2')-T(P2)]$$

where T(P2) is the ignition time at an intersection point P2 ac(P2) is the throttle position or opening at an intersection point P2

T(P2') is the ignition time at a virtual intersection point P2' ac(P2) is the throttle position or opening at a virtual intersection point P2'

The value at a virtual intersection point P2' represents the most suitable ignition time assuming that, although a throttle position or opening is on a higher side of the boundary value AC2', ignition is made based on the second ignition control map provided for the second injection mode. Such a virtual intersection point is given as a result of analytical examinations. When a throttle position or opening takes a value ac' slightly over the boundary value AC2' of the second ignition control map MP2, an ignition time T at a point P3A for the throttle position or opening ac' is calculated by interpolation with the aid of a value at an extreme intersection point P3 of the third ignition control map MP3 which is the closest intersection point to the boundary whose value is AC2' and a value at a virtual point P3' established on a lower throttle side from the boundary value AC'. The interpolation calculation of ignition time T(P3A) is made in a similar manner to the interpolation calculation for the ignition time T(P2A).

Otherwise, an ignition time may be calculated based only on a value at a single intersection point in the event where a throttle position or opening is close to an boundary value. That is, when a throttle position or opening takes a value ac slightly before the boundary value AC2' of the second ignition control map MP2, an ignition time T for the throttle position or opening ac is determined based only on a value at an extreme intersection point P2 of the second ignition control map MP2 closest to the boundary between the second and third ignition control maps MP2 and MP3 and given as a value at a point P2B. Similarly, when a throttle position or opening takes a value ac' slightly over the boundary value AC2' of the second ignition control map MP2, an ignition time T for the throttle position or opening ac' is determined based only on a value at an extreme intersection point P3 of the third ignition control map MP3 closest to the boundary between the second and third ignition control maps MP2 and MP3 and given as a value at a point P3B. An ignition time for a detected throttle position or opening is close to the boundary value AC1' while the engine load increases or the boundary value AC1 or AC2 while the engine load decreases, an ignition time is determined in the same manner as described above for an ignition time for a throttle position or opening close to the boundary value AC2' while the engine load increases.

If an ignition time for an throttle position or opening ac or ac' is calculated as a value at a point P or P' by interpolation with the aid of values at extreme intersection points P2 and P3 of the second and third ignition control maps MP2 and MP3, respectively, closest to the boundary, it takes merely a mean value of the values at the extreme intersection points P2 and P3, which makes it hard to advance ignition timing quickly in response to a switch from the second injection mode to the third injection mode or to retard quickly ignition timing in response to a switch from the third injection mode to the second injection mode.

As apparent from the preceding description in conjunction with FIG. 7, ignition timing is changed in quick response to a switch from one to another injection control mode with an effect of significantly reducing a torque shock caused during the switch of injection control mode.

Figure 8:
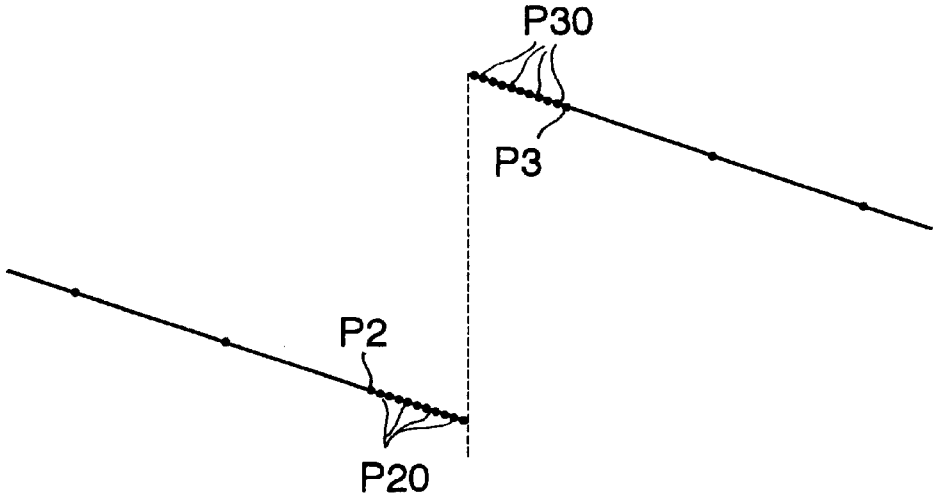
FIG. 8 is an explanatory illustration showing another calculation of ignition time.
Figure 9:
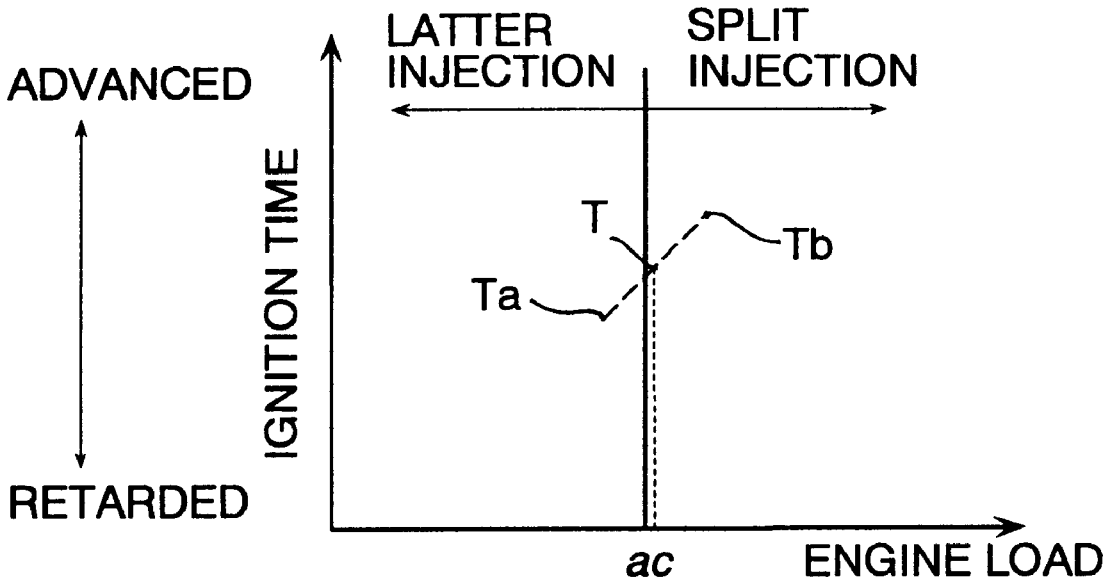
FIG. 9 (PRIOR ART)
FIG. 9 is an explanatory illustration showing a prior art calculation of ignition time by interpolation.

FIG. 8 is an explanatory view showing another manner of determining an ignition time for a detected throttle position or opening which is close to a boundary value. As shown in FIG. 7, each ignition control map may have a number of intersection points, such as denoted by P20 in the second ignition control map MP2 and denoted by P30 in the third ignition control map MP2 for example, at regular short distances between its extreme intersection point (P2 in the second ignition control map MP2 and P3 in the third ignition control map MP2) and its boundary. The dense area including the intersection points P20, P30 permits approximate determination of an ignition time without calculation by interpolation. However, the provision of an dense area of a number of additional intersection points imposes constraints not only on structure of the engine control unit 40 but on design work. Specifically, the engine control unit 40 is required to have an increased capacity of memory for data of the increased number of intersection points and their associated values. Further, a number of additional intersection points must be determined only after establishment of boundary values of the ignition control maps which is generally achieved at a latter stage of design work of the microcomputer of the engine control unit 40. These constraints makes the design work of the engine control unit 40 troublesome and increases steps of the design work of the engine control unit 40 and its associated elements. Viewed in this light, it is preferred to employ the injection time and ignition control map shown in FIGS. 3 and 7.

Although the ignition time has been described as a control value, a latter injection time or both ignition time and latter injection time may be employed as control values. Further, a quick increase in the amount of fuel to be injected may be caused to make up a lack of engine output torque during a switch from the first injection control mode MD1 (latter injection) to the second injection control mode MD2 (split injection). Furthermore, the ignition control map section is not always necessary to be divided to separate control maps correspondingly to the separate injection control modes but may be a single map which covers the entire range of engine operating conditions. In this case, the ignition control map is designed and adapted to change the control value discontinually at a boundary between each adjacent injection modes and, when an engine operating condition is close to the boundary value, the control value is determined on condition that it is prohibited to perform the calculation of control value by interpolation with the aid of values at intersection points corresponding to intersection points of the adjacent injection control modes.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. An engine control system for controlling operation of an internal combustion engine in first and second injection modes in which fuel injection into a combustion chamber of the engine is made at different timings according to engine operating conditions, said engine control system comprising:

speed detection means for detecting an engine speed;

load detection means for detecting an engine load;

memory means for storing a first engine control value map in the form of grid pattern which specifies continuous first engine control values corresponding to ones of engine speeds and engine loads at intersection points for a first range of ones of specified engine speeds and specific engine loads and a second engine control value map in the form of grid pattern, separated from said first engine control value map by a boundary, which specifies continuous second engine control values, discontinuous from said first engine control values, corresponding to ones of engine speeds and engine loads at intersection points for a second range of said ones of specific engine speeds and specific engine loads adjacent to said first range of specific engine speeds and specific engine loads, each one of said first and second engine control value maps specifying a virtual engine control value continuous from said engine control values of said each one of said first and second engine control value maps at a virtual intersection point in another one of said first and second engine control value maps for a specific engine speed and a specific engine load; and engine control means for controlling the engine with one of said first and second engine control values in one of said first injection mode and said second injection mode according to engine speeds and engine loads;

wherein said engine control means, when a point in said grid pattern on which said detected engine speed and said detected engine load lie is further from said boundary than an extreme one of said intersection points closest to said boundary, determines an engine control value for said detected engine speed and said detected engine load by interpolation with said engine control values at said intersection points on both sides of said point of one of said first and second engine control value maps in which said point in included and, when said point is closer to said boundary than said extreme intersection point, determines an engine control value for said detected engine speed and said detected engine load by interpolation with said engine control value at said closest intersection point of one of said first and second engine control value maps and said engine control value at said virtual intersection point of another one of said first and second engine control value maps.

2. The engine control system as defined in claim 1, wherein said first and second injection modes are a later injection mode in which fuel injection is made during a compression stroke and an early injection mode in which fuel injection is made during an intake stroke, respectively, and said first and second engine control value maps specifies said first and second engine control values for later and early fuel injection, respectively.

3. The engine control system as defined in claim 2, wherein engine control means causes a switch from said first injection mode to said second injection mode when said engine load increases from said first range to said second range.

4. The engine control system as defined in claim 2, wherein said engine control means determines a timing at which fuel reaches an ignition plug of each combustion chamber of the engine as said first engine control value.

5. The engine control system as defined in claim 1, wherein each of said first and second engine control values comprises an ignition timing.

6. The engine control system as defined in claim 5, wherein said first and second injection modes are a later injection mode in which fuel injection is made during a compression stroke and an split injection mode in which fuel injection is separately made during both intake stroke and compression stroke, respectively, and said first and second engine control value maps specifies ignition timings advanced discontinuously as said first and second engine control values at said extreme intersection points, respectively.

7. The engine control system as defined in claim 6, wherein said memory means further stores a third engine control value map in the form of grid pattern, separated from said second engine control value map by a boundary, which specifies continuous third engine control values, discontinuous from said second engine control values, corresponding to ones of engine speeds and engine loads at intersection points for a third range of said ones of specific engine speeds and specific engine loads adjacent to said second range of specific engine speeds and specific engine loads, and said engine control means controls the engine with one of said third engine control values in an early injection mode in which fuel injection is made during an intake stroke.

8. The engine control system as defined in claim 1, wherein said engine control value is one of advancement and retardation for fuel injection made in a compression stroke.

9. The engine control system as defined in claim 1, wherein said control value is timing at which fuel injection is made.

10. An engine control system for controlling operation of an internal combustion engine of a type which fuel injection is made directly into a combustion chamber of the engine in different injection modes, including a later injection made in which fuel injection is made during a compression stroke and an early injection mode in which fuel injection is made during an intake stroke, according to engine operating conditions, said engine control system comprising:

an injector for injecting fuel directly into a combustion chamber of the engine;

an engine speed sensor for detecting an engine speed of rotation as one of said engine operating conditions;

an engine load sensor for detecting an engine load as one of said engine operating conditions; and a controller having a memory for storing a first engine control value map in the form of grid pattern which specifies continuous first engine control values corresponding to ones of engine speeds and engine loads at intersection points for a first range of ones of specific engine speeds and specific engine loads and a second engine control value map in the form of grid pattern, separated from said first engine control value map by a boundary, which specifies continuous second engine control values, discontinuous from said first engine control values, corresponding to ones of engine speeds and engine loads at intersection points for a second range of said ones of specific engine speeds and specific engine loads adjacent to said first range of specific engine speeds and specific engine loads, each one of said first and second engine control value maps specifying a virtual engine control value continuous from said engine control values of said each one of said first and second engine control value maps at a virtual intersection pint in another one of said first and second engine control value maps for a specific engine speed and a specific engine load, and controlling the engine with one of said first and second engine control values in one of said first injection mode and said second injection mode according to engine speeds and engine loads;

wherein said controller, when a point in said grid pattern on which said detected engine speed and said detected engine load lie is further from said boundary than an extreme one of said intersection points closest to said boundary, determines an engine control value for said detected engine speed and said detected engine load by interpolation with said engine control values at said intersection points on both sides of said point of one of said first and second engine control value maps in which said point is included and, when said point is closest to said boundary than said extreme intersection point, determines an engine control value for said detected engine speed and said detected engine load by interpolation with said engine control value at said closest intersection point of one of said first and second engine control value maps and said engine control value at said virtual intersection point of another one of said first and second engine control value maps.

* * * * *